US009174828B2

(12) United States Patent
Stokes

(10) Patent No.: US 9,174,828 B2
(45) Date of Patent: Nov. 3, 2015

(54) LIFT ASSEMBLY AND SYSTEM

(76) Inventor: Van Stokes, Nutley, NJ (US)

( * ) Notice: Subject to any disclaimer, the term of this patent is extended or adjusted under 35 U.S.C. 154(b) by 405 days.

(21) Appl. No.: 12/751,176

(22) Filed: Mar. 31, 2010

(65) Prior Publication Data

US 2010/0258774 A1 Oct. 14, 2010

Related U.S. Application Data

(60) Provisional application No. 61/168,448, filed on Apr. 10, 2009, provisional application No. 61/168,405, filed on Apr. 10, 2009.

(51) Int. Cl.
*B66F 3/00* (2006.01)
*B66F 3/28* (2006.01)
*B66F 3/24* (2006.01)

(52) U.S. Cl.
CPC .... *B66F 3/28* (2013.01); *B66F 3/24* (2013.01)

(58) Field of Classification Search
CPC ..... B66F 3/46; B66F 3/28; B60S 9/02; B60S 9/12
USPC ..... 254/89 H, 2 B, 89 R, 93 VA, 93 L; 414/458, 459
See application file for complete search history.

(56) References Cited

U.S. PATENT DOCUMENTS

| | | | | | |
|---|---|---|---|---|---|
| 1,928,368 | A * | 9/1933 | Coffey | 92/43 |
| 3,289,868 | A * | 12/1966 | Miller et al. | 254/45 |
| 3,554,491 | A * | 1/1971 | Tegtmeier | 254/387 |
| 3,567,271 | A * | 3/1971 | Gostomski | 296/164 |
| 3,640,502 | A * | 2/1972 | Bargman, Jr. | 254/45 |
| 3,931,997 | A * | 1/1976 | Enami | 299/10 |
| 5,800,114 | A * | 9/1998 | Secondi | 414/458 |
| 6,168,227 | B1 * | 1/2001 | Lofting | 296/156 |

* cited by examiner

*Primary Examiner* — Elizabeth A Plummer
(74) *Attorney, Agent, or Firm* — Timothy X. Gibson, Esq.; Gibson & Dernier LLP

(57) ABSTRACT

A portable, lightweight lift system employing one or more lift assemblies that counters effects of staging is disclosed. The lift system includes multiple lift assemblies, wherein each assembly may be connected to a lifting device such as a hydraulic or motorized jack. A lifting device comprises moving parts which are nested such that the difference in diameters of each of the moving parts is minimized. In one aspect, the lifting device is provided with an arrangement of seals such that, the working area of a smaller diameter tube is greater than the working area of a larger diameter tube causing the smaller tube to move before the larger tube.

16 Claims, 19 Drawing Sheets

LIFT ASSEMBLY AND SYSTEM

CROSS-REFERENCE TO RELATED APPLICATIONS

This application claims the benefit of U.S. Provisional Patent Application No. 61/168,448, filed Apr. 10, 2009 and U.S. Provisional Patent Application No. 61/168,405, filed Apr. 10, 2009 the entireties of which are incorporated herein by reference.

FIELD OF THE INVENTION

The present invention relates to a portable lift assembly and system that can be connected to an object and raise and lower the connected object.

BACKGROUND OF THE INVENTION

The shipment of goods by various carriers including aircraft, ships, railroad, trucks and the like typically involve the use of standardized shipping containers that can be transferred from one carrier to another. The development of shipping containers that have a standardized shape and size allows for the similar treatment of the shipping container regardless of where in the world or what type of carrier is being used. Thus, goods can be efficiently shipped around the world without having to transfer the contained goods from one shipping container to another. Thus a shipping container may be initially loaded, then placed on and then transferred to a series of carriers until reaching a final destination, all without handling the goods loaded in the shipping container.

The transfer of the shipping container between carriers or staging areas increases the time it takes to ship goods from the point of origin to the final destination point. Transfers are especially burdensome when the transfer is not accomplished by heavy-duty lifting equipment, such as cranes, that can easily hoist and move a shipping container. For example, many transfer and final destination points do not have a crane for the loading or off-loading of a shipping container from a flatbed of a semi-trailer truck and therefore require some type of jack or other similar lifting apparatus. Further, a jack or other similar lifting apparatus may be required to be transported to a stalled or broken-down truck in order to transfer the shipping container to another truck. Currently there is no simple, portable, lightweight, easily installed device capable of lifting a fully loaded shipping container sufficiently to remove it from or replace it upon a flatbed trailer or chassis.

In addition, the conventional lifting apparatus generally includes a three-part telescoping device with two moving parts positioned within a container or barrel. The smaller of the two moving parts is enclosed within the larger of the two moving parts. Hydraulic pressure applied to a container acts against the two moving parts simultaneously. The result is that the larger of the two moving parts moves first because it has a larger area. Once the larger of the two moving parts reaches its maximum extension the smaller of the two moving parts begins to move.

One of the problems with this type of device is an action called staging. Because the hydraulic fluid is generally applied to the lift device at a fixed continuous rate the two moving parts move at different rates depending upon the difference in their areas. As stated above, the larger of the two moving parts moves first, and because it is the larger of the two areas it moves with more force but less speed than the second moving part. When the first moving part reaches its full extension and stops moving the second moving part begins to move at a much lower force but a higher speed than the first moving part. The large difference in area between the first moving part and the second moving part causes the object being moved to move erratically when the device changes stages (i.e., when the first moving part stops and the second moving part begins its movement).

Furthermore, the conventional telescoping device is large and heavy due to the many moving parts adding to the weight of a lifting assembly. The overall dimensions are large such that these devices cannot be used in space-limited applications. Rather, smaller conventional non-telescoping devices would be necessary. As a consequence, the space-limited applications would then be limited as to the full extension length that can be achieved.

SUMMARY OF THE INVENTION

In view of the foregoing, various embodiments disclosed herein provide for a lift system that is lightweight, portable and can be used at any desired location by one person.

A lightweight lift system for lifting objects is disclosed in accordance with this embodiment. The lift system comprises at least one portable lifting assembly configured to be attached to an object, for example a shipping container, to be lifted and a lifting device to raise the object. In a more detailed aspect, the lift system can comprise multiple lifting assemblies of similar configuration to be attached to the object. The lifting assembly comprises a connecting member with a plurality of support surfaces for engaging the object to be lifted. At least one of the plurality of support surfaces may include at least one angle plate shaped to conform to a part of the object to be lifted and provides support for the lifting assembly. Another portion of the connecting member may include a lift plate which receives a fastening mechanism that engages an aperture located on one side of the object. In addition, the lifting assembly can comprise a lifting device engagement member adapted to receive a lifting device. A plurality of struts can be employed to connect the connecting member to the lifting device engagement member. The lifting device engagement member may include one or more bushing(s), cradle(s), and/or collar(s) configured to receive the lifting device. In one embodiment the lifting device is adjustable in that the angle formed between one side of the object and the lifting device at which the lift system is stable may be adjusted to suit a particular application of the lift system. For example, the distance between a corner edge of the connecting member and a center of the bushing at which the lift system is stable may be adjusted. The bushing(s), cradle(s), and/or the collar(s) are oriented along a vertical member such that a resulting size and shape of the lifting device engagement member may receive and secure the lifting device. When placed in the lifting device engagement member, one end of the lifting device may abut the one or more bushing(s) and another end of the lifting device may be encompassed by the collar.

In accordance with different aspects, the lifting device can be a telescoping lifting device or a non-telescopic lifting device. In a more detailed aspect, if the lifting device is a three part telescoping lifting device it can comprise at least two moving parts positioned within a container or barrel. All the moving parts have different diameters and are stacked into various arrangements to facilitate storage of the lifting device. In one embodiment a three part telescoping lifting device comprises a housing stage, a large diameter moving stage and a small diameter moving stage oriented such that the small diameter moving stage engages both the housing stage and the large diameter moving stage. In a further aspect, the lifting device is provided with an arrangement of seals such that the working area of the small diameter moving stage is greater than the working area of a larger diameter moving stage causing the small diameter moving stage to move before the larger diameter moving stage.

Another embodiment relates to a multipart telescoping apparatus comprising a plurality of stages. A housing stage is employed for nesting moving parts of the telescoping apparatus, a large diameter moving stage is nested within the housing stage and further facilitates storing a small diameter moving stage that engages the housing stage and the large diameter moving stage when the telescoping apparatus is fully extended. The different stages are configured such that relative diameters of the large diameter moving stage and the small diameter moving stage can be in the ratio of, for example, 90:66, 78:54 or 4:3. Further, the diameters of the housing stage, the small diameter moving stage and the large diameter moving stage can range from 10 to 200 mm.

The multipart telescoping apparatus further comprises a first sealing connection sized such that the large diameter moving stage and the housing stage are snugly engaged at each end of the first sealing connection. A second sealing connection is also provided such that it can travel along the length of the small diameter moving stage until it meets the first sealing connection. Further, the second sealing connection comprises three different sections with different diameters. A first section of the second sealing connection with a first diameter is sized to snugly engage the small diameter moving stage. A second section diameter is sized to engage the housing stage while a third section diameter of the second sealing connection engages the large diameter moving stage. Seals such as O-rings or other types of hydraulic seals are provided between the various stages of the multipart telescoping apparatus to create liquid tight seals. The multipart telescoping apparatus also comprises two pistons including a narrow portion and a wider portion. The narrow portion of the first piston is shaped and sized to snugly engage the small diameter moving stage while its wider portion is shaped and sized to engage the housing stage. Similarly, the narrow portion of the second piston is shaped and sized to engage the small diameter moving stage and the wider portion is shaped and sized to engage the large diameter moving stage.

A method of minimizing staging in a lifting apparatus is disclosed in accordance with this embodiment. This methodology involves minimizing a difference in diameters of a plurality of moving stages of a telescoping lifting device while maximizing the effective working area of each of the moving stages of the telescoping lifting device. In one aspect, the effective working area of each of the moving stage is maximized by providing a small diameter moving stage between a housing stage and a large diameter moving stage. This is facilitated by providing two different sealing connections. A first sealing connection is provided in the telescoping lifting device such that the large diameter moving stage and the housing stage are snugly engaged at each end of the first sealing connection. A second sealing connection is also provided with sections of different diameters such that it can travel along the length of the small diameter moving stage while engaging the small diameter moving stage, the housing stage and the large diameter moving stage. Such an arrangement of seals facilitates providing the smaller diameter tube/moving stage with a working area greater than the working area of the larger diameter tube/moving stage thereby causing the smaller tube to move before the larger tube.

Given above is a simplified summary of the claimed subject matter in order to provide a basic understanding of some aspects described herein. This summary is not an extensive overview, and is not intended to identify key/critical elements or to delineate the scope of the claimed subject matter.

BRIEF DESCRIPTION OF THE DRAWINGS

To assist those of ordinary skill in the relevant art in making and using the subject matter hereof, reference is made to the appended drawings, wherein.

Figure 1A:
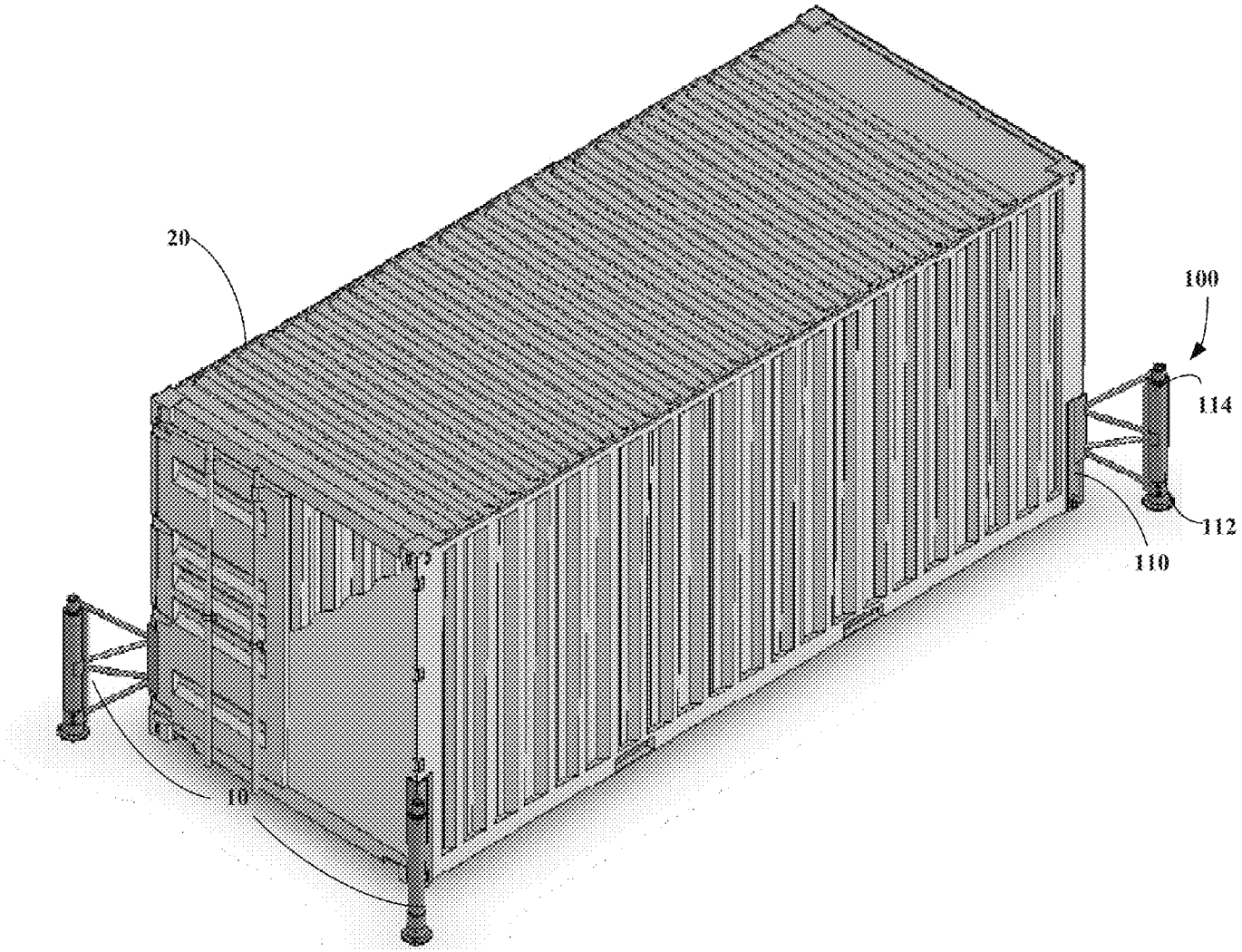
FIG. 1A depicts an embodiment of a lift system connected to a shipping container in accordance with an aspect disclosed herein.

It should be noted that the appended drawings illustrate only typical embodiments of this invention and are therefore not to be construed as limiting of its scope, for the invention may admit to other equally effective embodiments. Where possible, identical reference numerals have been inserted in the figures to denote identical elements.

DETAILED DESCRIPTION OF THE INVENTION

The following is a detailed description of the invention provided to aid those skilled in the art in practicing the present invention. Those of ordinary skill in the art may make modifications and variations in the embodiments described herein without departing from the spirit or scope of the present invention. Unless otherwise defined, all technical and scientific terms used herein have the same meaning as commonly understood by one of ordinary skill in the art to which this invention belongs. The terminology used in the description of the invention herein is for describing particular embodiments only and is not intended to be limiting of the invention. All publications, patent applications, patents, figures and other references mentioned herein are expressly incorporated by reference in their entirety.

In the following description, for purposes of explanation, specific numbers, materials and configurations are set forth in order to provide a thorough understanding of the invention. It will be apparent, however, to one having ordinary skill in the art that the invention may be practiced without these specific details. In some instances, well-known features may be omitted or simplified so as not to obscure the present invention. Furthermore, reference in the specification to phrases such as "one embodiment" or "an embodiment" means that a particular feature, structure or characteristic described in connection with the embodiment is included in at least one embodiment of the invention. The appearances of phrases such as "in one embodiment" in various places in the specification are not necessarily all referring to the same embodiment.

A lift system employing one or more lift assemblies in accordance with different aspects disclosed herein overcomes the problems associated with conventional systems. By applying one or more of the embodiments described herein a shipping container can be raised or lowered to a suitable height under which a flat bed may fit. These embodiments are designed so that one person may use it on a fully loaded shipping container, lift and load or unload the shipping container on a flatbed trailer, chassis or the like without any additional equipment while experiencing minimal staging effects.

Figure 1B:
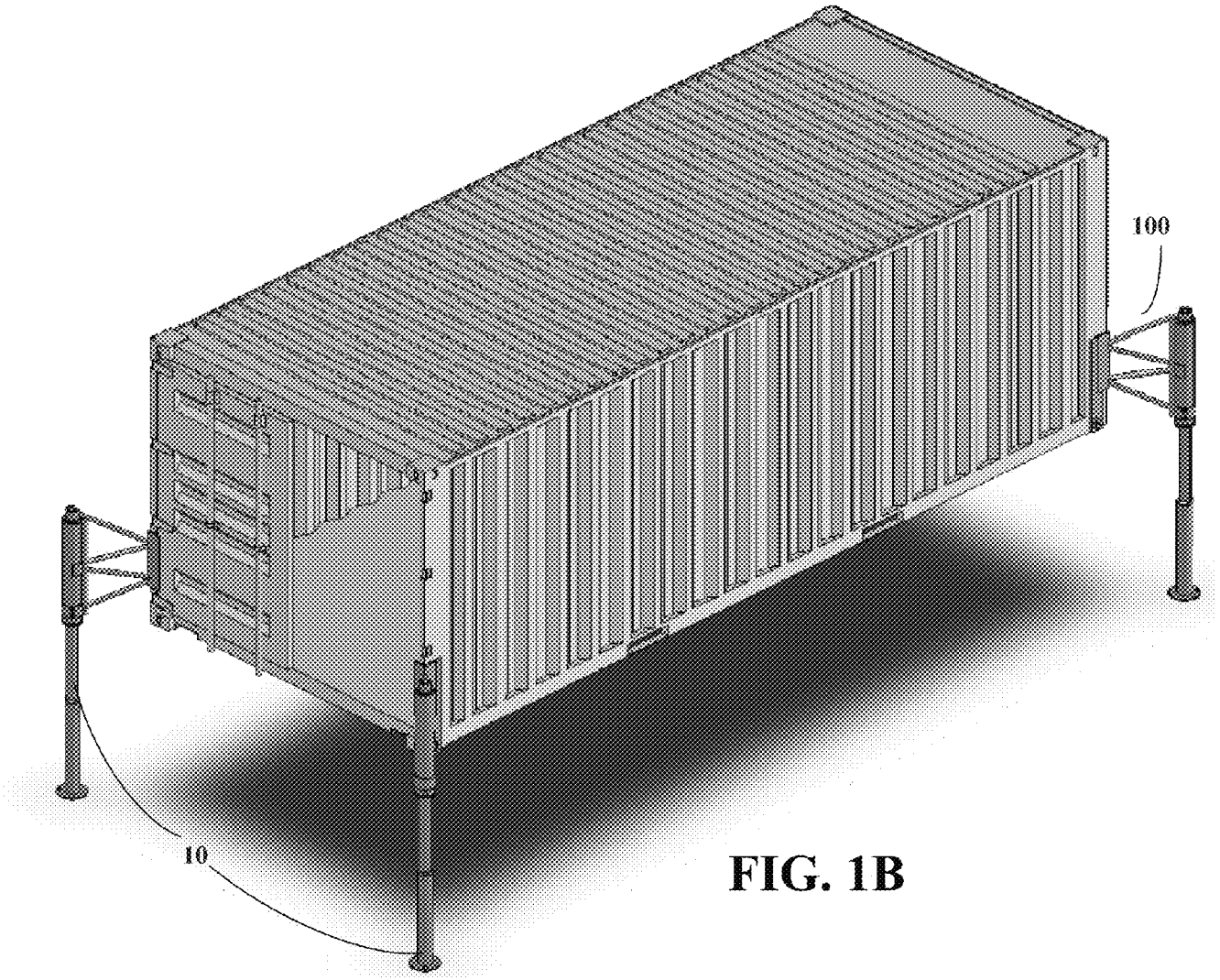
FIG. 1B depicts the lift system of FIG. 1A where the lifting devices are extended.

The advantages of the lift assembly and system disclosed herein include it being compact, lightweight and portable such that it can be stowed in a transport vehicle; and its ease of use such that it can be used by one person. Turning now to the details of the drawings, FIGS. 1A and 1B are a view of a lift system 10, in accordance with one or more aspects disclosed herein, that is connected to a shipping container 20. FIG. 1A depicts a lift system 10 in the lowered conformation and FIG. 1B depicts the lift system in the raised conformation. The lift system 10 includes at least one lifting assembly 100, at least one lifting device 114, and can optionally further include at least one power source such as a hydraulic pump (not shown). The lifting assembly 100 is shaped and sized to conform to a section of the shipping container. For example, FIG. 1A depicts a lifting assembly attached to a corner of a shipping container 20 and to optionally engage container apertures (not shown) such as may be located for example on each corner of a container. Standardized shipping containers 20 typically include uniform castings including an aperture at each of the corners for the purposes of securing the shipping containers 20 during transport and as a connection point for cranes to hoist or elevate the shipping containers 20 from a staging area to a carrier or from one carrier to another carrier.

It is contemplated that the lifting assembly 100 is light enough so that one person can position and connect them to the shipping container 20 without any additional help or equipment. Once the lifting assembly 100 is attached to the shipping container 20 the lifting devices 114 can be activated to raise the shipping container 20. In one embodiment, the lifting devices 114 are hydraulic jacks, which can be further connected to a hydraulic pump (not shown) which is then used to produce hydraulic pressure to raise the shipping container 20. Various schemes can be used to assure that the shipping container 20 is raised evenly on the four corners. One scheme involves using a separate hydraulic valve for each of the four lifting assemblies 100 where the person would be responsible to keep the shipping container 20 level as it is lifted or lowered. Another scheme is to use a device, such as an accelerometer or other like device, that may be attached to the shipping container 20 and would indicate to a computer or controller the level state of the shipping container 20 and cause it to make adjustments accordingly to each lifting assembly 100. Although the FIGS. 1A and 1B show three lifting assemblies 100 (a fourth not shown is located at the unseen fourth corner of the container) of similar shapes attached to the four corners of the shipping container 20, it can be appreciated that this is not necessary. More or fewer lifting assemblies 100 of different shapes made to be attached to other parts of the shipping container 20 can also be contemplated in accordance with different aspects. Selection of different lifting assemblies 100 for lifting a shipping container 20 can be made based on the attributes of the shipping container 20, for example, its weight.

Figure 2:
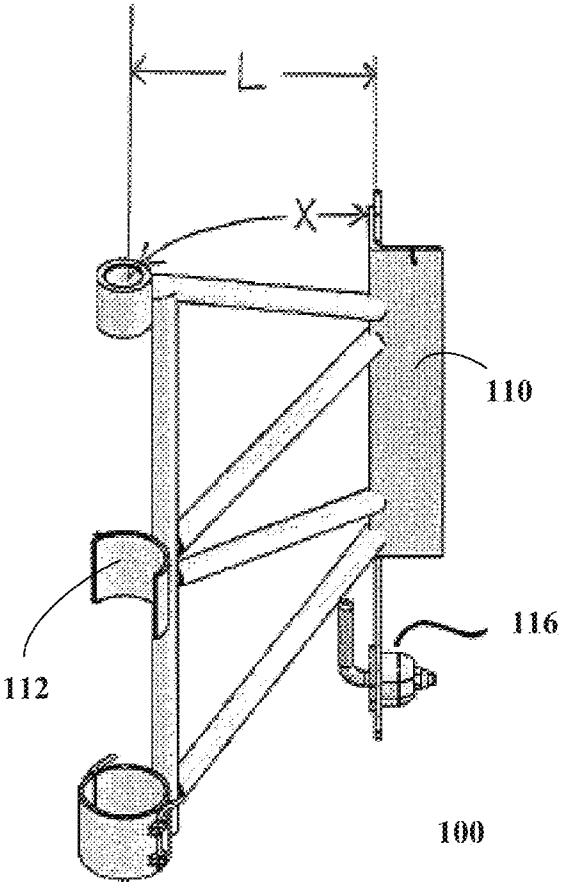
FIG. 2 depicts an exploded and a perspective view of one embodiment of a lifting assembly in accordance with one aspect.
Figure 2:
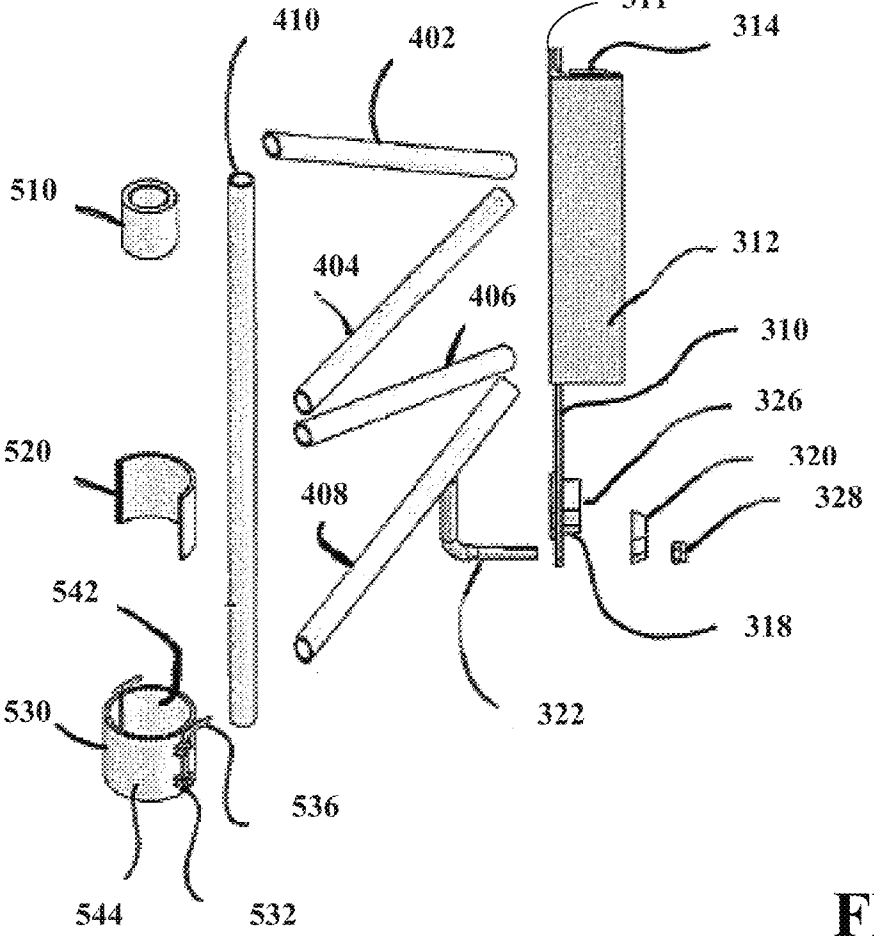

Now referring to FIG. 2, an embodiment the lifting assembly 100 is disclosed herein. It includes a connecting member 110 for engaging a container or other item to be lifted, and a lifting device engagement member 112. The connecting member 110 may include a plurality of support surfaces, such as a lift plate 310, an angle plate 312, and one or more spacer plates 314, and is configured to conform to a corner of the shipping container 20 and provide support for the lifting assembly 100. The lift plate 310 receives a fastening mechanism 116 that engages the container aperture located on one side of the shipping container 20. The fastening mechanism 116 may include a lift pin 318, a latch head 320, a left or right turn handle 322 and a lift pin nut 328, all of which are oriented in such a manner as to secure the lift plate 310, and thus the lifting assembly 100, via the aperture to the shipping container 20. As will be apparent to those skilled in the art, the connecting member 110 and the fastening mechanism 116 may be adapted to connect to various sized and shaped objects.

The lifting device engagement member 112 can include a sleeve according to one embodiment of the invention which includes in one embodiment a bushing 510, a cradle 520, and a collar 530 having complementary opposing sides 542 and 544. In one embodiment the collar 530 further includes a plurality of collar hinges 532 held together with a collar pin 536. The collar hinges 532 are disposed on the ends of the opposing side 542 with complementary collar hinges 532 disposed on the ends of the opposing side 544 such that the opposing sides 542 and 544 are held together with the collar pin 536 to form the collar 530. As will be apparent to those skilled in the art, the lifting device engagement member 112 may be adapted to receive various shapes and sizes of lifting devices, including non-telescoping and telescoping lifting devices.

A plurality of struts may be employed to connect the connecting member 110 to the lifting device engagement member 112. In one embodiment, the plurality of struts include an upper strut 402, an upper brace strut 404, a lower brace strut 406 and a collar strut 408 extending from the outer corner edge of the angle plate 312 and fused to various positions along the length of a vertical member 410. The bushing 510, cradle 520, and collar 530 are oriented along the vertical member 410 and upper member 402 such that the resulting size and shape of the lifting device engagement member 112 may receive and secure the lifting device 114. As shown, one or more of the plurality of struts may be joined to the lifting device engagement member 112, such as the bushing 510. The lifting device 114 is situated in the engagement member 112 so that one end of the lifting device 114 abuts the bushing 510 and the other end of the lifting device 114 is encompassed by the collar 530. As will be apparent to those skilled in the art, the plurality of struts for connecting the connecting member 110 to the lifting device engagement member 112 may include additional or fewer struts as previously described depending on the size of the lifting assembly 10 and/or the particular application. These tubes may be replaced by another connecting device such as a unitary piece.

It is contemplated that the struts 402, 404, 406, 408 and 410 may be sized and/or modified to be adapted to connect to objects other than the shipping container 20. The diameters, thickness and lengths of the struts 402, 404, 406, 408 and 410 are any suitable diameter, thickness and length for a given application. For example, diameters may range from 15-50 mm but may be larger. Thickness may range from 3-15 mm but may be larger. Length will vary depending on the particular strut and demands of a particular application, and may range from 200-1500 mm but may be larger The angle, X, defined as the angle between one side of the shipping container 20 and the lifting device 114 at which the lift system is stable, may be adjusted and/or optimized by the skilled artisan to suit a particular application of the lift system 10. The length, L, defined as the distance between the upper corner edge 311 of the angle plate 312 and the center of the bushing 510 at which the lift system 10 is stable, may also be adjusted and/or optimized by the skilled artisan to suit a particular application of the lift system 10. The orientation of the connecting member 110, the lifting device engagement member 112 and the plurality of struts may be adapted to optimize the stability and strength of the lift assembly 100. The upper strut 402, upper brace strut 404, lower brace strut 406 and a collar strut 408 are oriented to each other and the connecting member 110 and lifting device engagement member 112 through optimal angles and strut lengths so as to provide a rigid and sturdy bridge that is able to withstand the load of a fully loaded shipping container 20. It is contemplated that the orientation of the parts of the connecting member 110 and lifting device engagement member 112 will differ depending upon whether the lifting assembly 100 is fitted for a left-hand or right-hand corner of the shipping container 20.

Figure 3:
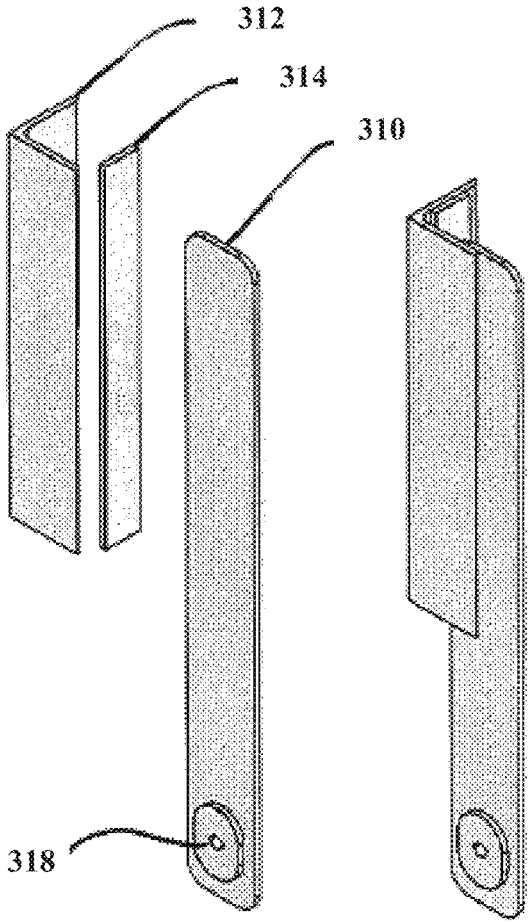
FIG. 3 is a perspective view of an embodiment of a connecting member used in the lifting assembly in accordance with one aspect.
Figure 4:
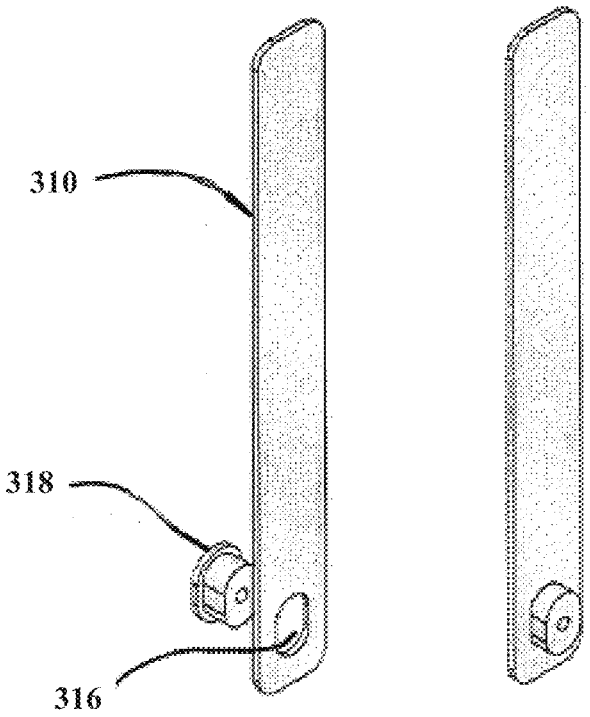
FIG. 4 depicts a perspective view of one embodiment of a lift plate and lift pin in accordance with one aspect of the present invention.

Now referring to FIGS. 3 and 4 in one embodiment the lift plate 310 and spacer plate 314 are disposed on the angle plate 312 in an orientation to allow the fastening mechanism 116, in this embodiment the lift pin 318, to engage the aperture on the right or left corners of the shipping container 20. It can be appreciated that the lift plate 310, the spacer plate 314 and the angle plate 312 can be also be fashioned to fit parts other than the corners of the shipping container 20. As shown in FIG. 4, the aperture 316 is shaped and sized to receive the fastening mechanism 116, in this embodiment a lift pin 318. It is contemplated that the parts may be shaped, sized and/or modified to be adapted to connect to objects other than the shipping container 20.

Figure 5:
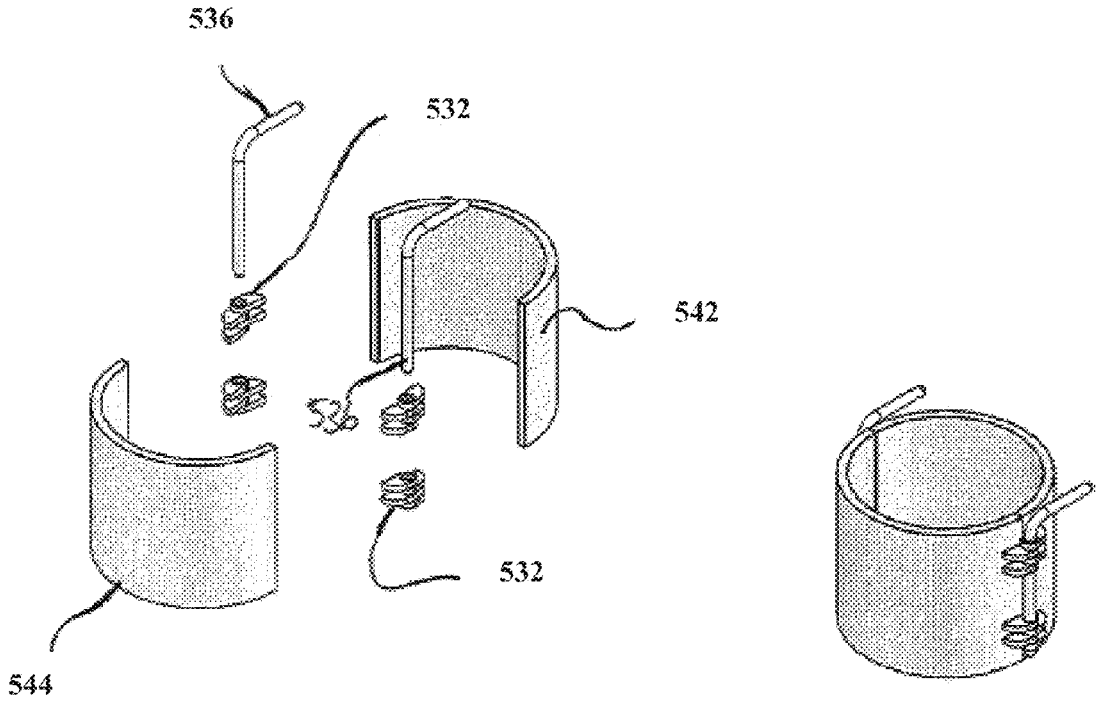
FIG. 5 depicts a perspective view of one embodiment of a collar in accordance with one aspect of the present invention.

Now referring to FIG. 5, in one embodiment the collar 530 includes complementary opposing sides 542 and 544 which are fastened to each other by two collar pins 536 that engage a plurality of collar hinges 532. The securing of the lifting device 114 within the collar 530 is accomplished by removing the two collar pins 536 to disengage the complementary opposing sides 542 and 544.

Figure 6:
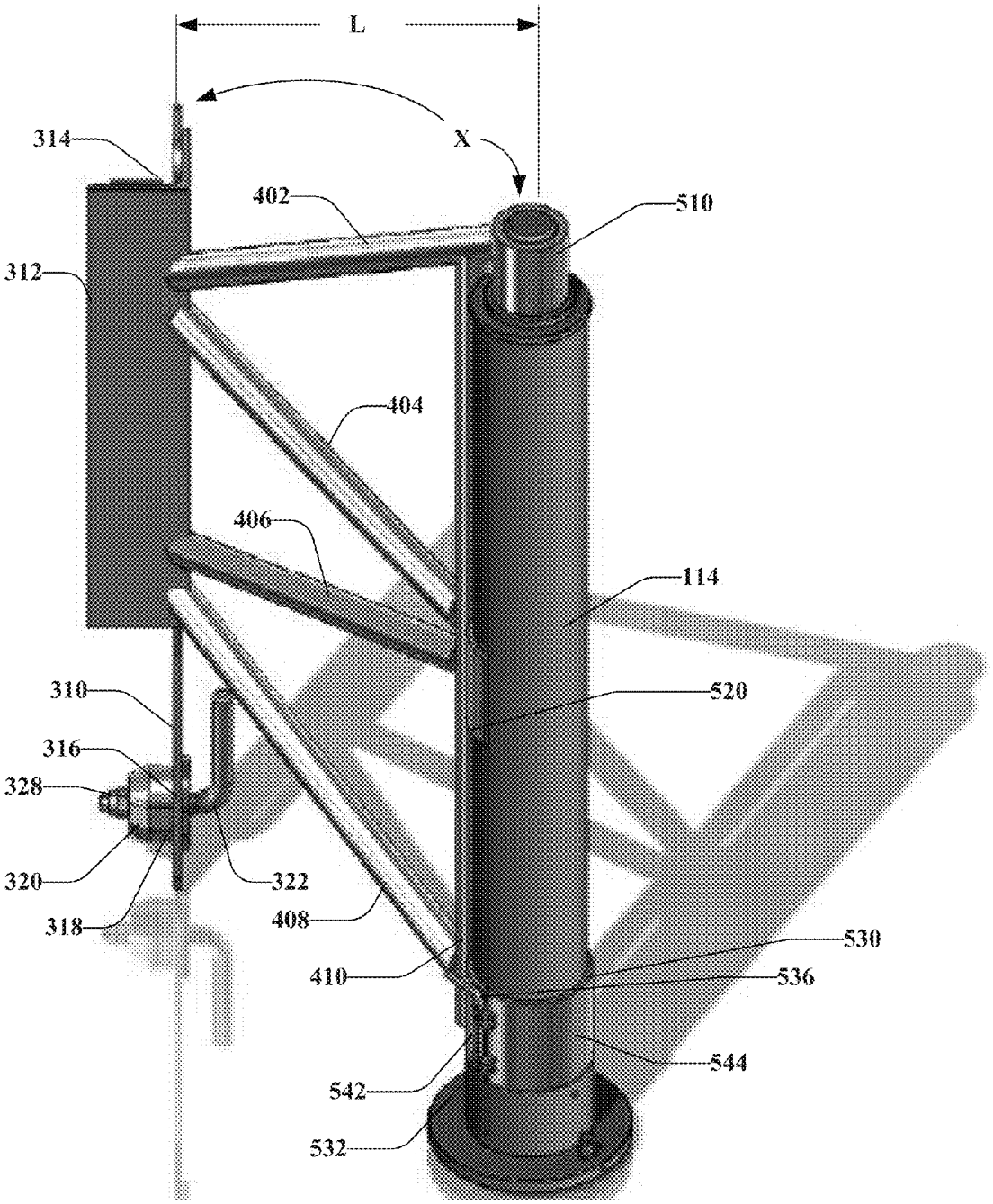
FIG. 6 depicts a perspective view of an embodiment of a lifting assembly and lifting device in accordance another aspect.

FIG. 6 illustrates how the lifting device 114 is accommodated into the lifting assembly 100 to lift the shipping container 20. As shown, one end of the lifting device 114 is received by the bushing 510 and cradle 520. The collar 530 formed from holding opposing ends 542 and 544 by passing the collar pin 536 through apertures 534 is secured around the body of the lifting device 114 and functions to hold the lifting device 114 in place as a force such as hydraulic pressure is introduced.

In accordance with an aspect, the lifting device 114 can be a three-part telescoping device with at least two moving parts positioned within a container or barrel. In accordance with a more detailed aspect, the moving parts can all have different diameters and be stacked into various arrangements as further detailed infra. When hydraulic pressure is applied to the container 20 it acts against the two moving parts simultaneously. The result is that the larger of the two moving parts first moves because it has a larger area. Once the larger of the two moving parts reaches its maximum extension the smaller of the two moving parts begins to move.

In a standard telescoping device each moving section or stage of the device is made correspondingly smaller because it is designed to fit inside the prior stage. With the two moving sections fully retracted the hydraulic pressure applied to the device acts upon the sum of the areas of the two moving parts. Once the larger of the two moving parts reaches full extension the hydraulic pressure can only act on the area of the smaller part. Due to the smaller moving part being contained within the larger moving part the difference in the areas is significant, especially considering that the effective working area of the smaller part is further reduced by the clearance required for seals and tolerances. Because the area of a circle is calculated by $\pi r^2$ a small difference in the diameter makes a large difference in the area. In a standard telescoping device the placing of the smaller moving part within the larger moving part causes a very large difference in the areas and therefore a very large difference in the force and speed generated between the two moving parts.

In view of the foregoing, various embodiments detailed herein relate to a telescoping device that is smaller in size and reduces the erratic movements resulting from the staging effects between the different moving parts. Further, it facilitates reduction of the very large difference in the force and speed generated between the two moving parts. The multipart telescoping apparatus 114 in accordance with various aspects detailed herein overcomes the problems of other standard telescoping apparatuses. The lightweight multipart telescoping apparatus 114 described herein achieves a higher force than a conventional telescoping device of the same size and reduces staging effects. By applying one or more embodiments detailed herein, a user can replace the conventional telescoping device with the instant lifting device 114 to achieve a smoother motion over the entire extension of the multipart telescoping apparatus 114. Additionally, the user can apply one or more embodiments of the telescoping apparatus 114 in space-limited applications where only conventional non-telescoping devices are currently used.

In accordance with one or more aspects, the multipart telescoping apparatus 114 preferably includes two moving parts. The difference between the diameters of the first and second moving parts is very small and the staging effect is kept to a minimum. Also because the apparatus uses tubular parts, solid rods are not required, achieving significant weight reduction. The reduced difference between the diameters of the moving parts allows the fabrication of a telescoping part with a smaller outside diameter which achieves the same ultimate force as a much larger conventional telescoping apparatus.

Figure 7:
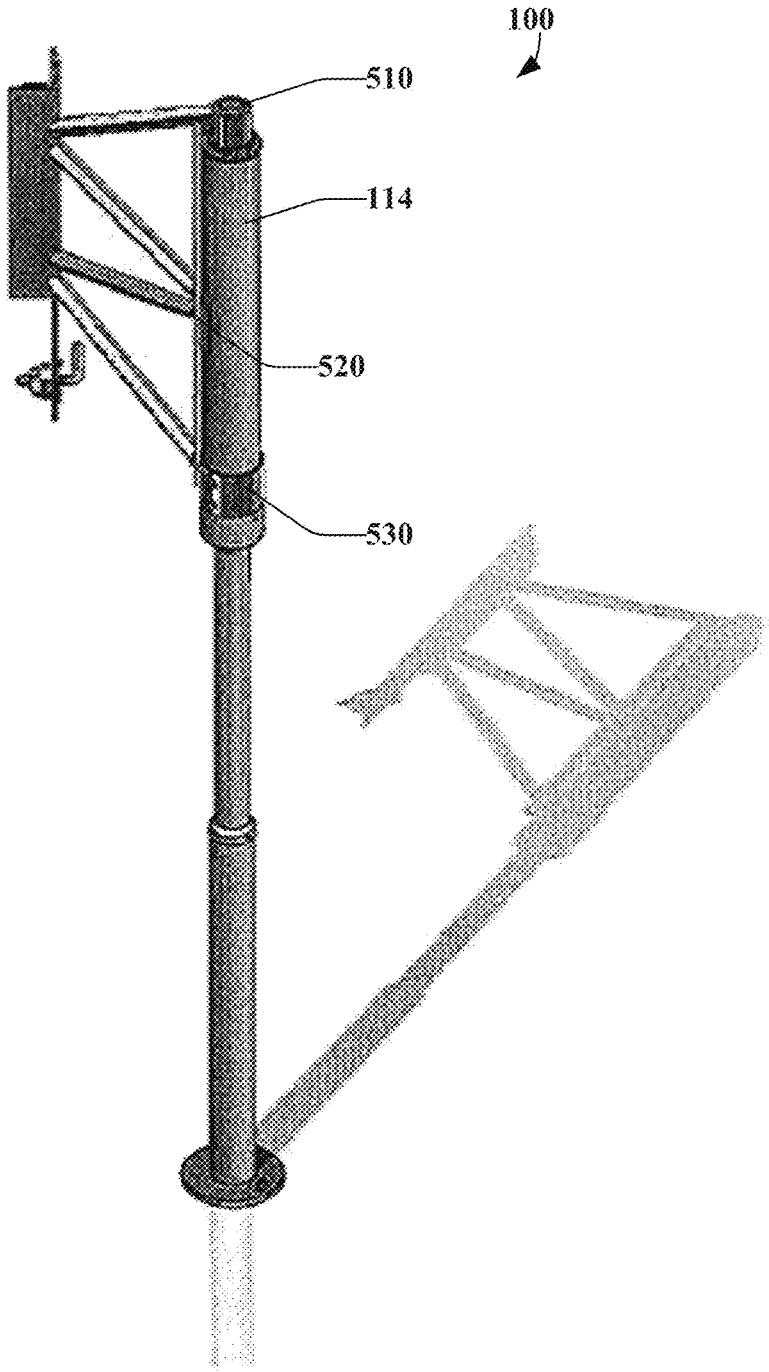
FIG. 7 depicts the lifting assembly and lifting device of FIG. 6 where the lifting device is extended.

As shown in FIG. 7, when the lifting device 114 is extended, the lifting device 114 exerts a force against the bushing 510 and thus results in raising the lifting assembly 100. The cradle 520 and collar 530 function to prevent the lifting device 114 from moving and/or disengaging the lifting assembly 100 as the lifting assembly 100 is raised or lowered.

Figure 8:
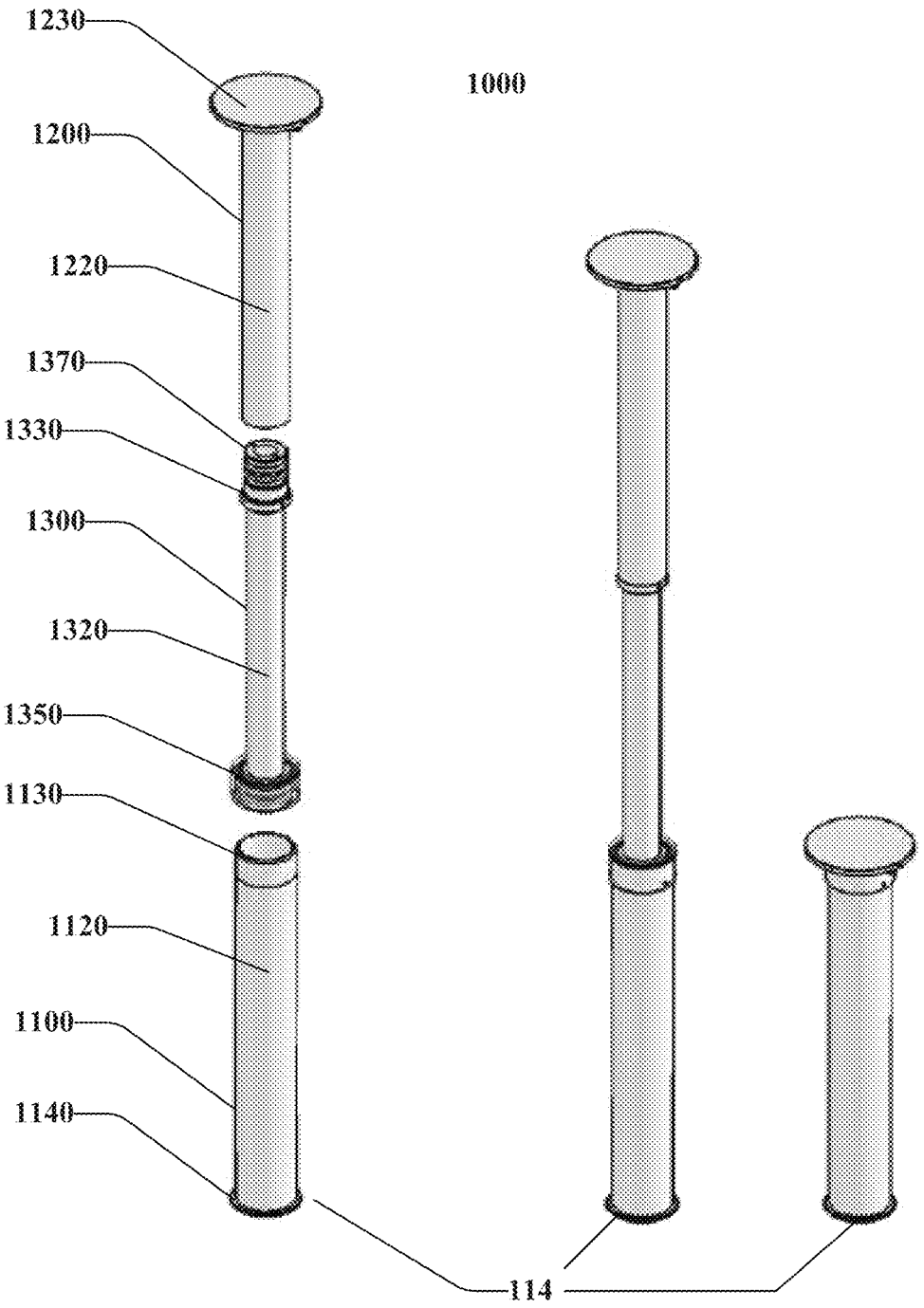
FIG. 8 depicts perspective, extended and exploded views of an embodiment of a lifting device in accordance with one aspect.

FIG. 8 depicts one embodiment of the lifting device 114, in this case a multipart telescoping lifting apparatus 1000. Telescoping apparatus 1000 includes a housing stage 1100, a large diameter moving stage 1200 and a small diameter moving stage 1300. The stages 1100, 1200 and 1300 are oriented such that the small diameter moving stage 1300 engages both the housing stage 1100 and the large diameter moving stage 1200. As pressure is applied by a hydraulic pump or other system (not shown) to the multipart telescoping apparatus 114, the exerted pressure acts upon the small diameter moving stage 1300 and forces it to move relative to the housing stage 1100 and extend until the small diameter moving stage 1300 is fully extended such that the exerted pressure cannot move the small diameter moving stage 1300 any further. The exerted pressure forces the large diameter moving stage 1200 to move relative to the housing stage 1100 and thus extends until the large diameter moving stage 1200 is fully extended such that the exerted pressure cannot move the large diameter moving stage 1200 any further. The multipart telescoping apparatus 114 is then fully extended.

The relative diameters of the large diameter moving stage 1200 and the small diameter moving stage 1300 result in a telescoping apparatus in which pressure exerted by the second moving part (in this case the large diameter moving stage 1200) is greater than approximately 60-90% of the pressure exerted by the first moving part (in this case the small diameter moving stage 1300). The diameters of the large diameter moving stage 1200 and the small diameter moving stage 1300 may be varied to suit a particular application so long as the desired exerted pressure is maintained. For example, in a telescoping apparatus in which the working diameter of the large diameter moving stage 1200 is approximately 4 inches and the working diameter of the small diameter moving stage 1300 is approximately 3 inches, the pressure exerted by the large diameter moving stage 1200 is approximately 80% of the pressure exerted by the small diameter moving stage 1300.

As will be apparent to those skilled in the art, the multipart telescoping apparatus 1000 may be adapted to have a size suitable for a particular application. The stages 1100, 1200 and 1300 may be longer, shorter, wider or narrower depending on the application. As will be apparent to those having skill in the art, the stages may have a cross sectional shape other than a circle, for example, the cross section may be an oval, a triangle, a square, a rectangle, oblong or other suitable shape. Likewise, the apparatus 1000 may include any number of stages appropriate for a particular application.

The housing stage 1100 includes a housing tube 1120 sized and shaped to receive the small diameter moving stage 1300 and the large diameter moving stage 1200. A first sealing connection 1130 such as a gland nut is at one end and a cap 1140 at an opposite end.

The large diameter moving stage 1200 includes a large diameter tube 1220 and a base plate 1230 having a shaft. The small diameter moving stage 1300 includes a small diameter tube 1320, a second sealing connection 1330 such as a gland nut, a first piston 1350 and a second piston 1370. The small diameter tube 1320 engages a second sealing connection 1330 (in this embodiment a gland nut), such that the second sealing connection 1330 can travel along the length of the small diameter tube 1320 until it meets the first sealing connection 1130. The second piston 1370 is shaped and sized to engage the large diameter tube 1220. The first piston 1350 is shaped and sized to engage the housing tube 1120.

The diameters of the tubes 1120, 1220 and 1320 are any suitable diameters for a given application. Preferably diameters may range from 10 to 200 mm for portable apparatus but may be larger. Non-portable devices may include larger diameter tubes. The ratio of working diameter of the large diameter tube 1220 to the small diameter tube 1320 may vary for a given application. Examples of appropriate ratios of the working diameters of the large diameter tube 1220 to the small diameter tube 1320 include 90:66, 78:54 and 4:3.

The lengths of the tubes 1120, 1220 and 1320 are any suitable lengths for a given application. Preferably lengths may range between 100 to 1500 mm for portable apparatus but may be larger. Non-portable devices may include longer lengths.

The apparatus 1000 moves from a closed to an extended position by hydraulic pressure provided by a hydraulic pump. As hydraulic pressure is applied, the first piston 1350, and thus the small diameter tube 1320, is forced along the length of the housing tube 1120 until it is stopped by the first sealing connection 1130. The hydraulic pressure then forces the large diameter tube 1220 to move over the second piston 1370 until the second sealing connection 1330 meets and is stopped by the second piston 1370. At this point, the multipart telescoping apparatus 1000 is fully extended. O-rings or other types of hydraulic seals may be employed to create liquid tight seals. The multipart telescoping apparatus 1000 will retract to the resting orientation as the hydraulic pressure is released.

Figure 9:
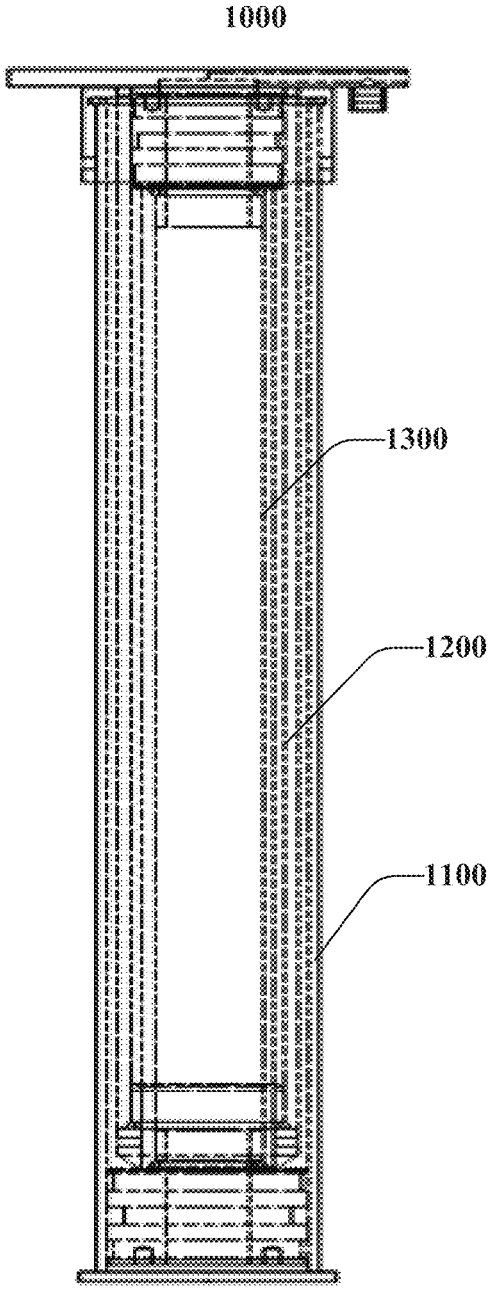
FIG. 9 depicts a cross sectional view of the multipart telescoping apparatus of FIG. 8.

As shown in FIG. 9, in the closed position the apparatus 1000 includes the stages 1100, 1200 and 1300 untelescoped and nested. In the closed position, the multipart telescoping apparatus 1000 is small and compact such that it can be used in applications where space is limited and otherwise not suitable for standard telescoping apparatus.

Figure 10:
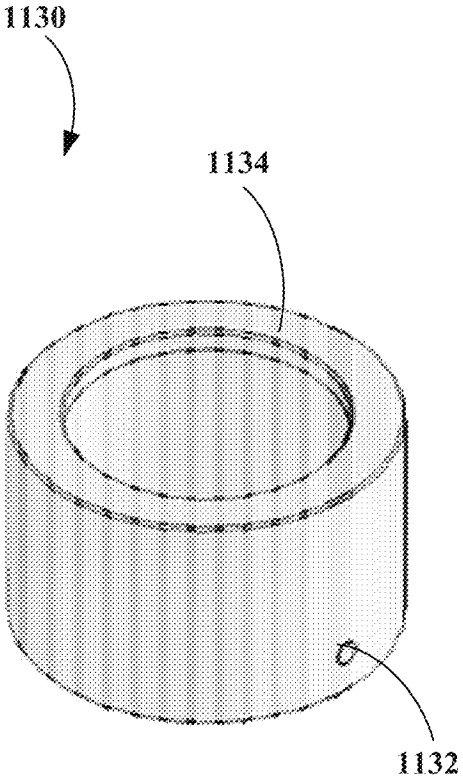
FIG. 10 depicts a perspective view of one embodiment of a sealing connection of the housing stage.
Figure 10:
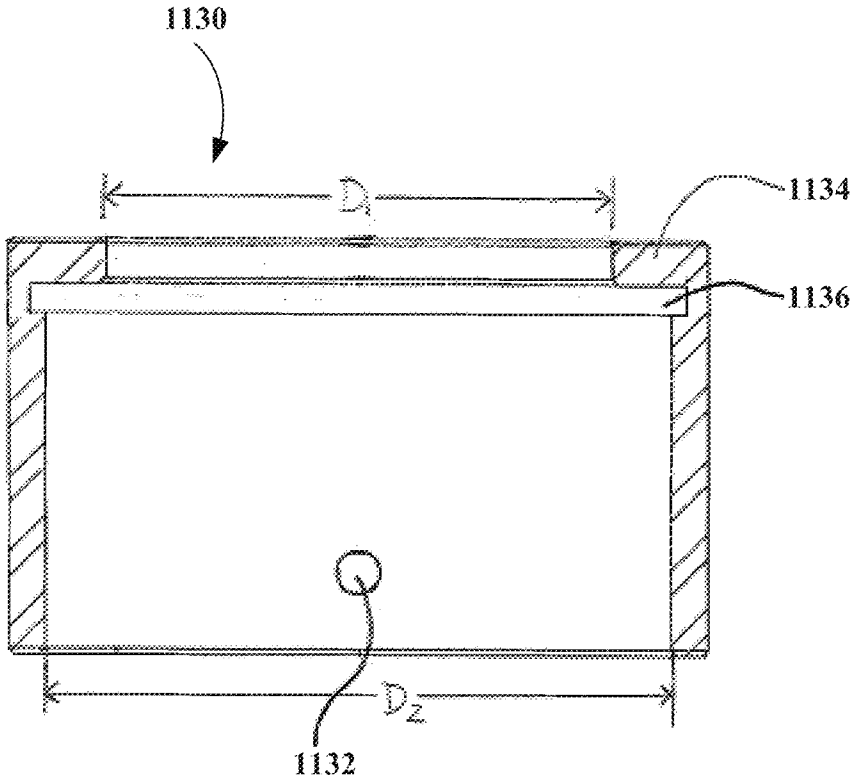

Now referring to FIG. 10, the first sealing connection 1130 is a gland nut further including an aperture 1132, an upper rim surface 1134 and an interior groove 1136. The diameter, $D_1$, of the first sealing connection 1130 is sized such that the large diameter tube 1220 can snugly engage the first sealing connection 1130. The diameter, $D_2$, of the first sealing connection 1130 is sized such that the housing tube 1120 can snugly engage the first sealing connection 1130. The upper rim surface 1134 functions to prevent the housing tube 1120 from extending completely through the first sealing connection 1130. To create a liquid tight seal an O-ring sized and shaped to conform to the interior groove 1136 is placed between the first sealing connection 1130 and the housing tube 1120. The first sealing connection 1130 may be secured to the housing tube 1120 by various means known to a skilled artisan, such as a set screw or the like, to for example engage the aperture 1132 when the sealing connection is a gland nut.

Figure 11:
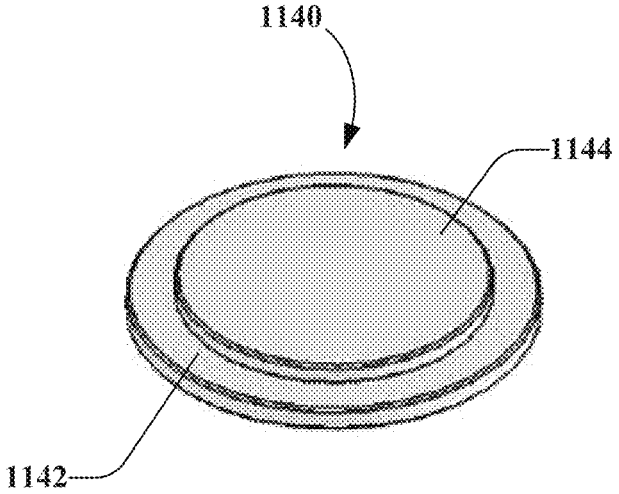
FIG. 11 depicts a perspective view of one embodiment of a cap of the housing stage.

Now referring to FIG. 11, the cap 1140 may be fixed or removably engaged to housing tube 1120. The cap 1140 may include surfaces such as a surface 1142 and a raised surface 1144. The raised surface 1144 sized and shaped to fit the housing tube 1120. A sealing device such as an O-ring may be used to engage raised surface 1144 to create a liquid tight seal between the cap 1140 and the housing tube 1120.

Figure 12A:
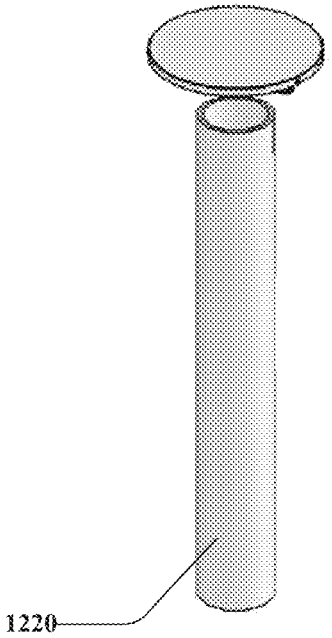
FIGS. 12A and 12B depict perspective and cross sectional views respectively of one embodiment of a large diameter moving stage of a multipart telescoping apparatus.
Figure 12A:
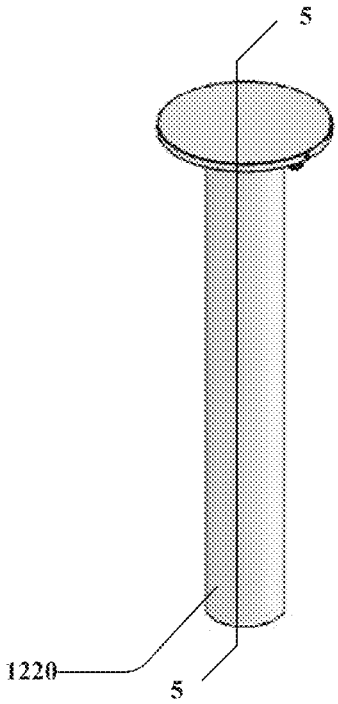
Figure 12B:
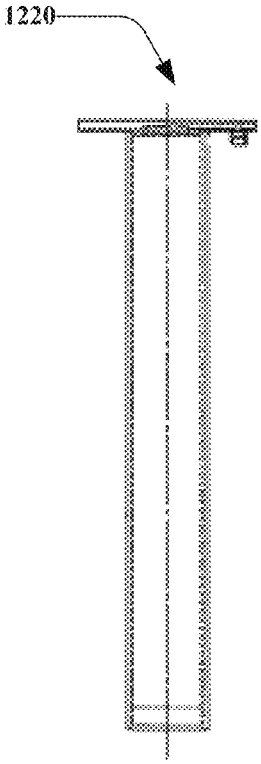

Now referring to FIGS. 12A-B, FIG. 12A illustrates a prespective view of the large diameter tube 1220 sized and shaped to receive the small diameter tube 1320 (not show in this figure) while FIG. 12B shows a cross sectional view of the large diameter moving stage along line 5-5.

Figure 13:
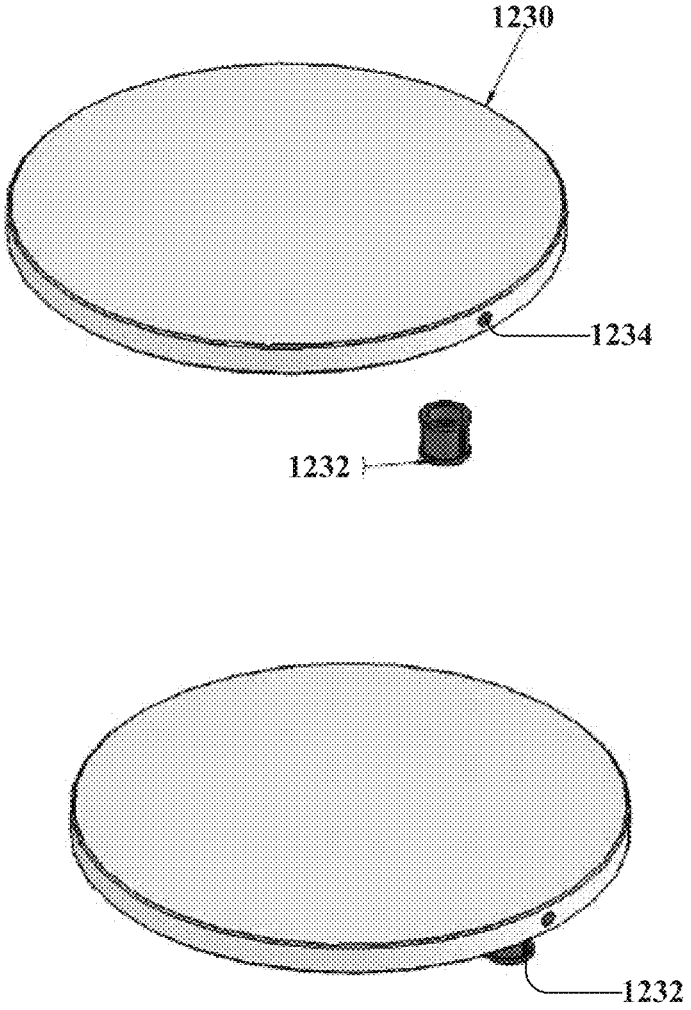
FIG. 13 depicts a perspective view of one embodiment of a base plate of the large diameter moving stage.

FIG. 13 illustrates a base plate 1230 of the large diameter tube 1220. A bore 1234 extends from the peripheral edge of the base plate 1230 through to the interior of the base plate 1230. The large diameter tube 1220 is sealed at one end by the base plate 1230. It is contemplated that the bore 1234 and the shaft 1232 function as part of a sealing mechanism to create a liquid tight seal between the large diameter tube 1220 and the base plate 1230. A sealing device such as but not limited to an O-ring may used to further enhance the liquid tight seal. It will be apparent to a skilled artisan various sealing means may be used to seal elements discussed herein.

Figure 14:
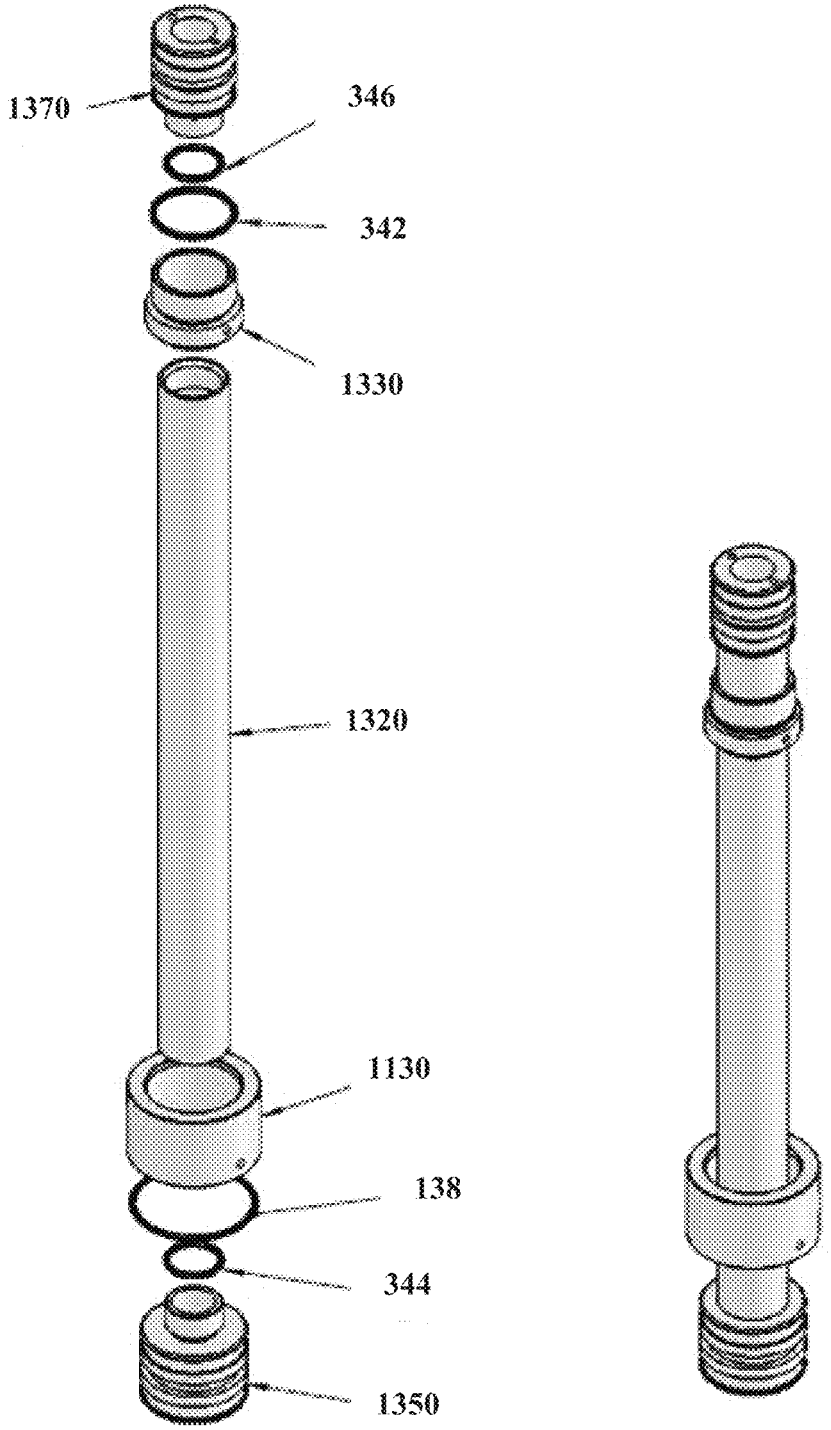
FIG. 14 depicts perspective and exploded views of one embodiment of a small diameter moving stage of a multipart telescoping apparatus.

As depicted in FIG. 14, the small diameter tube 1320 engages a second sealing connection 1330 (in this embodiment a gland nut), such that the second sealing connection 1330 can travel along the length of the small diameter tube 1320 until it meets the first sealing connection 1130, the sealing connection being achieved with O rings (346, 342, 138 and 344). The second piston 1370 is shaped and sized to engage the large diameter tube 1220. The first piston 1350 is shaped and sized to engage the housing tube 1120.

Figures 15A, 15B:
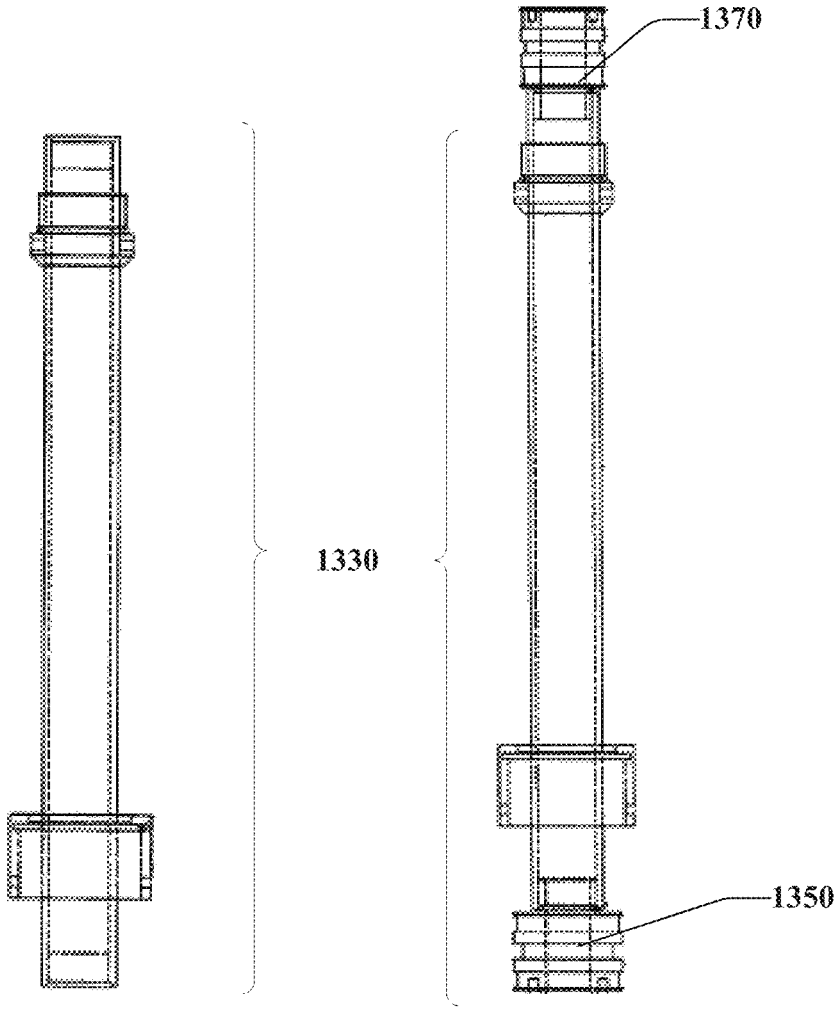
FIG. 15A depicts a cross sectional view of the small diameter moving stage.
FIG. 15B depicts another cross sectional view of the small diameter moving stage.

FIGS. 15A-15B are cross-sectional views of the small diameter moving stage 1300 without (15A) and with (15B) the first piston 1350 and second piston 1370.

Figure 16:
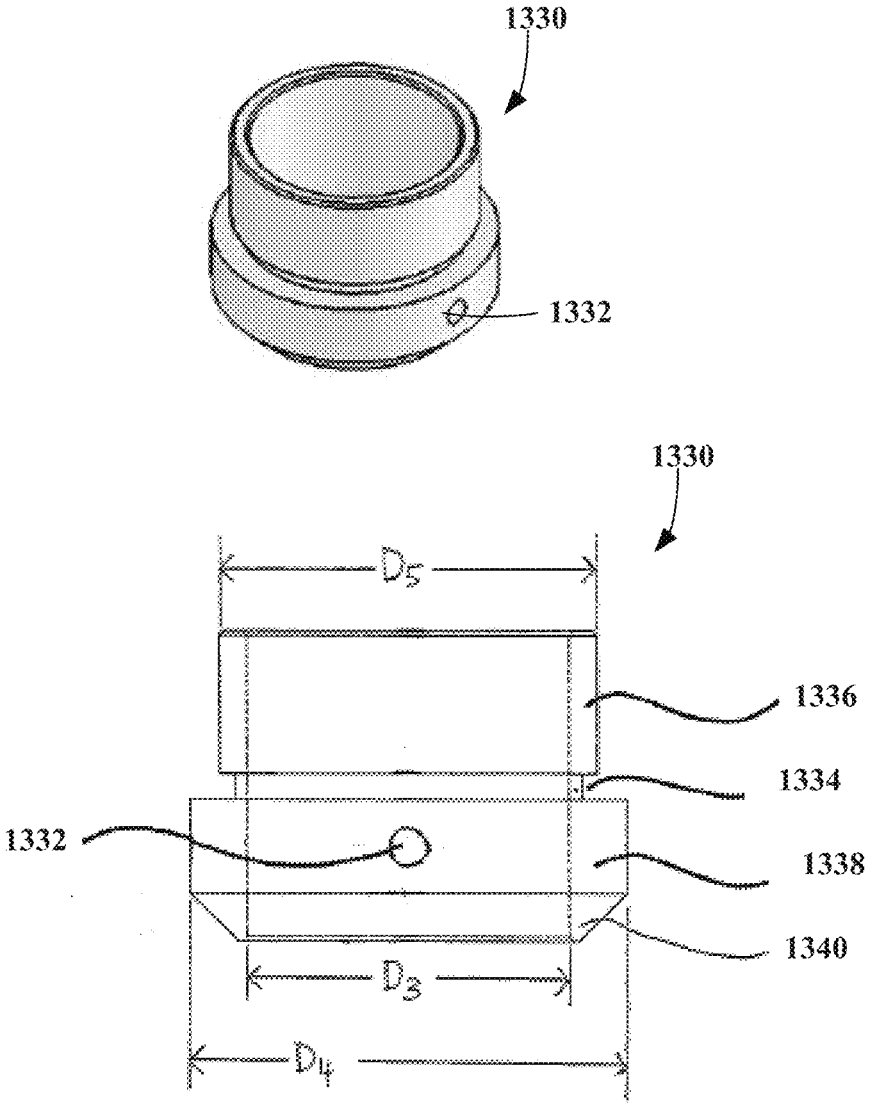
FIG. 16 depicts perspective and cross sectional views of one embodiment of a sealing connection of the large diameter moving stage.

In FIG. 16 illustrates an embodiment of the second sealing connection 1330 including an aperture 1332, a groove 1334 situated between a narrow portion 1336 and a wide portion 1338 having an angular portion 1340. The diameter, $D_3$, of the second sealing connection 1330 is sized such that the small diameter tube 1320 can snugly engage the second sealing connection 1330. The diameter, $D_4$, of the second sealing connection 1330 is sized to engage the housing tube 1120. The diameter, $D_5$, of the second sealing connection 1330 is sized to engage the large diameter tube 1220. A liquid tight seal between the second sealing connection 1330 and the large diameter tube 1220 can be created by inserting an O-ring in the groove 1334.

Figure 17:
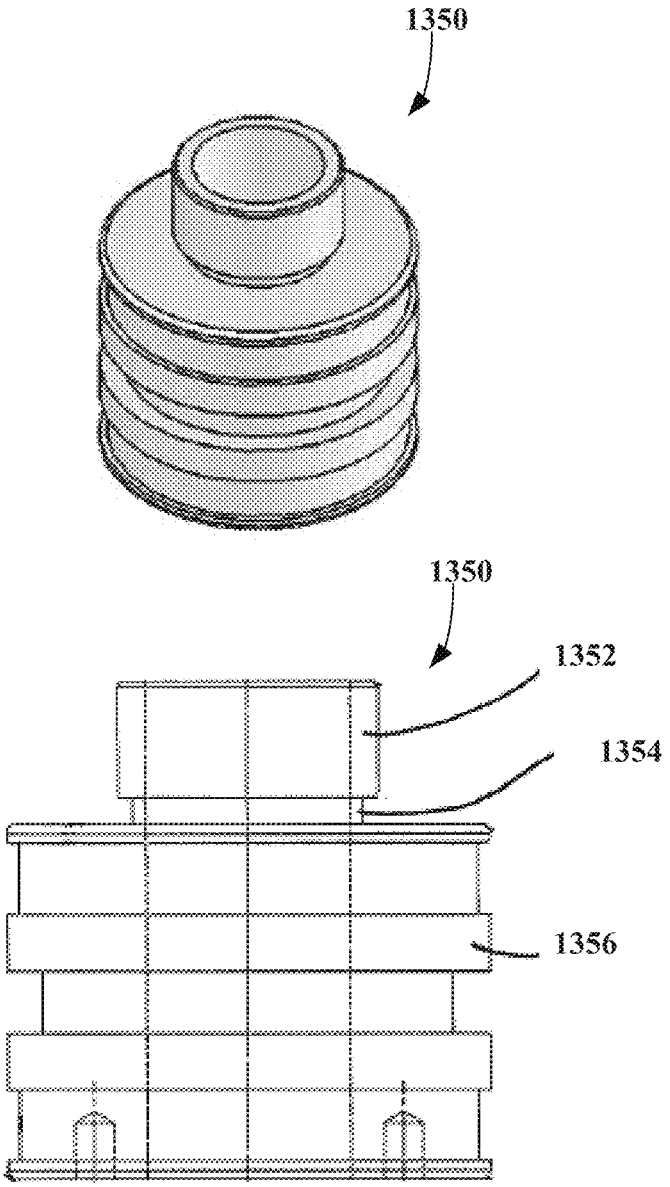
FIG. 17 depicts perspective and cross sectional views of one embodiment of a piston of the housing stage.

Now referring to FIG. 17, the first piston 1350 includes a narrow portion 1352 that is shaped and sized to snugly engage the small diameter tube 1320. A liquid tight seal is formed between the first piston 1350 and the small diameter tube 1320 such as by an O-ring inserted in a groove 1354. The first piston 1350 further includes a wider portion 1356 that is shaped and sized to snugly engage the housing tube 1120.

Figure 18:
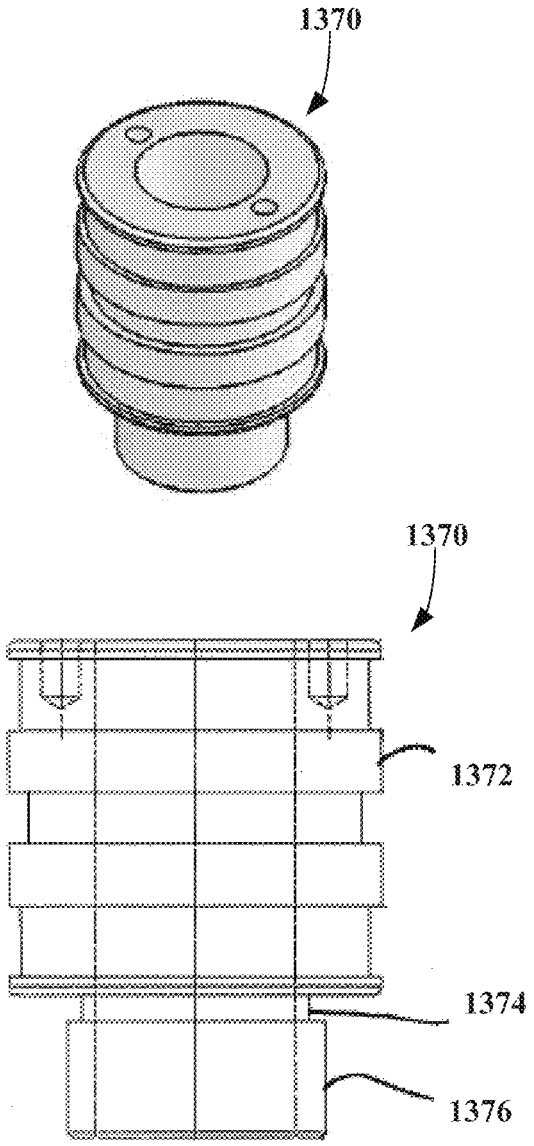
FIG. 18 depicts perspective and cross sectional views of one embodiment of a piston of the large diameter moving stage.

Now referring to FIG. 18, the second piston 1370 includes a narrow portion 1372 that is shaped and sized to snugly engage the small diameter tube 1320. A liquid tight seal is formed between the second piston 1370 and the small diameter tube 1320 such as by an O-ring inserted in a groove 1374. The second piston 1370 further includes a wider portion 1376 that is shaped and sized to snugly engage the large diameter tube 1220.

Although the systems and methods of the present disclosure have been described with reference to exemplary embodiments thereof, the present disclosure is not limited thereby. Indeed, the exemplary embodiments are implementations of the disclosed systems and methods are provided for illustrative and non-limitative purposes. Changes, modifications, enhancements and/or refinements to the disclosed systems and methods may be made without departing from the spirit or scope of the present disclosure. Accordingly, such changes, modifications, enhancements and/or refinements are encompassed within the scope of the present invention. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A lightweight, portable lift system for lifting a shipping container, comprising:

at least one portable lifting assembly comprising a lifting device engagement member comprising a vertical member comprising a bushing disposed proximal one end of the vertical member and at least one collar disposed distal of the bushing closer to another end of the vertical member, wherein the lifting device engagement member is releasably engageable to a portable lifting device, and a connecting member removably attachable to a shipping container to be lifted; and the portable lifting device selected from a hydraulic jack and a motorized jack releasably engageable to the bushing and the collar of the lifting device engagement member, the portable lifting device comprising a base end and an opposite end wherein the opposite end is removably insertable in the bushing and the bushing is operable to bear lifting force from the portable lifting device.

2. The lift system of claim 1, comprising four portable lifting assemblies.

3. The lift system of claim 1, wherein the connecting member comprises a plurality of support surfaces to engage the shipping container.

4. The lift system of claim 3, wherein at least one of the plurality of support surfaces includes at least one angle plate shaped to conform to a surface of the shipping container.

5. The lift system of claim 3, wherein the connecting member comprises a fastener operable to engage an aperture located on the shipping container.

6. The lift system of claim 1, further comprising a plurality of struts connecting the connecting member to the lifting device engagement member.

7. The lift system of claim 1, wherein the portable lifting device comprises a multipart telescoping lift apparatus comprising:

a housing stage for nesting moving parts of the telescoping apparatus;

a large diameter moving stage nested within the housing stage; and a small diameter moving stage nested within the large diameter moving stage that engages the housing stage and the large diameter moving stage when the telescoping apparatus is fully extended.

8. The lift system of claim 1, wherein the at least one collar comprises complementary opposing sides releasably fastened to each other for releasably engaging the portable lifting device.

9. The lift system of claim 1, comprising at least one cradle for supporting the lifting device disposed on the vertical member between the at least one bushing and at least one collar.

10. A portable lifting assembly for lifting a shipping container, comprising:

a lifting device engagement member comprising a vertical member comprising a bushing disposed proximal one end of the vertical member and at least one collar disposed distal of the bushing closer to another end of the vertical member, wherein the lifting device engagement member is releasably engageable to a first end of a portable lifting device comprising a first end and an opposite base end, the portable lifting device selected from a hydraulic jack and a motorized jack, wherein the first end is removably insertable in the bushing and the bushing is operable to bear lifting force from the portable lifting device and the collar is operable to releasably engage the portable lifting device;

a connecting member for removably engaging the shipping container; and at least one means connecting the lifting device engagement member to the connecting member.

11. The portable lifting assembly of claim 10, wherein the connecting member further comprises a plurality of support surfaces to engage the shipping container.

12. The portable lifting assembly of claim 11, wherein at least one of the plurality of support surfaces includes at least one angle plate shaped to conform to a corner edge of the shipping container.

13. The portable lifting assembly of claim 10, wherein the connecting member comprises a fastener operable to engage an aperture located on the shipping container.

14. The portable lifting assembly of claim 10, the means connecting the lifting device engagement member to the connecting member comprising a plurality of struts.

15. The portable lifting assembly of claim 10 comprising at least one cradle disposed on the vertical member between the bushing and at least one collar.

16. The portable lifting assembly of claim 10, wherein the at least one collar comprises complementary opposing sides releasably fastened to each other for releasably engaging the lifting device.

* * * * *